US006783106B2

(12) United States Patent
Barnes

(10) Patent No.: US 6,783,106 B2
(45) Date of Patent: Aug. 31, 2004

(54) WALL ARTICLE HANGING DEVICE AND METHODS OF USE

(76) Inventor: Renny Barnes, 8228 Richmond Hwy., Alexandria, VA (US) 22308

( * ) Notice: Subject to any disclaimer, the term of this patent is extended or adjusted under 35 U.S.C. 154(b) by 0 days.

(21) Appl. No.: 09/851,323

(22) Filed: May 9, 2001

(65) Prior Publication Data

US 2002/0166930 A1 Nov. 14, 2002

(51) Int. Cl.[7] ..... A47G 1/16

(52) U.S. Cl. ..... 248/476; 248/475.1; 248/216.1; 248/217.1

(58) Field of Search ..... 248/216.1, 217.1, 248/217.2, 217.3, 231.91, 475.1, 476

(56) References Cited

U.S. PATENT DOCUMENTS 797,983 A * 8/1905 Spengler
1,248,131 A * 11/1917 Kaplan
1,945,897 A * 2/1934 Haukedahl
2,443,149 A * 6/1948 Rundell ..... 248/264
3,298,651 A * 1/1967 Passer ..... 248/217
3,738,650 A * 6/1973 Ossenkop ..... 272/62
3,891,091 A * 6/1975 Anderson ..... 211/105.3
4,040,149 A * 8/1977 Einhorn ..... 248/493
4,458,872 A * 7/1984 Couch ..... 248/497
4,871,140 A * 10/1989 Hoskinson et al. ..... 248/496
5,236,168 A * 8/1993 Roy ..... 248/546
D339,981 S 10/1993 Barnes ..... D8/373
5,267,718 A * 12/1993 Sheehan ..... 248/475.1
5,328,139 A 7/1994 Barnes ..... 248/475.1
5,433,416 A * 7/1995 Johnson ..... 248/475.1
5,588,629 A 12/1996 Barnes ..... 248/475.1
5,758,858 A 6/1998 Barnes ..... 248/544
5,865,562 A * 2/1999 Mallek ..... 403/403
6,095,478 A 8/2000 Barnes ..... 248/475.1
6,186,466 B1 * 2/2001 Baird et al. ..... 248/475.1
6,431,510 B1 * 8/2002 Lydecker et al. ..... 248/216.1

* cited by examiner

*Primary Examiner*—Leslie A. Braun
*Assistant Examiner*—Steven Marsh
(74) *Attorney, Agent, or Firm*—Clark & Brody

(57) ABSTRACT

A wall article hanging device includes a hanger body and a prong element. The hanger body is adapted to attach to the rear of a wall article, and contains opposing slots to receive the prong element. The prong element facilitates attaching the wall article to a wall surface. The prong element is separable from the body element to ease handling of the article prior to article hanging. The hanger body can be used without the prong element for hanging a wall article using items such as a nail and wire.

6 Claims, 2 Drawing Sheets

WALL ARTICLE HANGING DEVICE AND METHODS OF USE

FIELD OF THE INVENTION

The present invention is directed to a wall article hanging device and methods of use, and in particular, to a hanging device including a separable prong element, its separability easing handling of the article prior to hanging and permitting alternative hanging techniques.

BACKGROUND ART

In the prior art, a number of techniques are employed to hang a wall article such as a picture, painting, mirror, tapestry, etc. One such technique employs a nail or other member that is attached to the wall, whereby the nail acts as the support for the article to be hung. The article to be hung can then be fitted with a wire, and the wire is slipped over the protruding nail to support the article. The article can also use other types of hanging devices such as serrated plates that are attached to the back of a frame, with the nail engaging one of the serrations on the plate for frame support. The article can also be hung by attaching a hanger device having a loop, whereby the nail would engage the loop for article support.

Another class of wall article hanging devices are disclosed in U.S. Pat. Nos. D339,981, 5,328,139, 5,588,629, 5,758,858, and 6,095,478 to Barnes. These patents run counter to the conventional wall article hanging techniques that first attach an element to the wall, and then hang the wall article off that wall element. In the Barnes' patents, a hanging device is first attached to the wall article to be hung, and then the wall article is secured to a wall surface. Using the Barnes' device and method, there is no need for locating a nail or the like at a predetermined location on the wall so as to position the wall article in the proper location. That is, the wall article itself is used for positioning in the proper site on the wall.

The Barnes' devices are also advantageous in that the wall article is secured in such a fashion that the article remains stationary after attachment, and the constant article leveling that goes on when a wire and nail are used is eliminated.

The Barnes' patents use one or more prongs as part of the attaching device and technique. One problem with these devices is that the prongs extend away from the article to be hung, and can pose a problem in terms of shipping and handling the wall article before it is hung. For example, if a Barnes' hanging device is first attached to a wall article, and then the wall article is shipped to a retail or wholesale location for resale, the prongs of the hanging device extend away from the back of the article to be hung. Since the prongs are pointed, they pose a hazard in terms of injuring one who is handling the article. To minimize this hazard, and the prongs can be covered in order to avoid such injury. Having to cover the prongs imposes an added burden when the article is being shipped or stored for sale or installation.

In light of the problem noted above, a need exists to provide an improved wall article hanging device. In response to this need, the present invention solves the problem of prong exposure by providing a device whereby the prongs of the device are separable until ready for use, i.e., separate from the part of the device retaining the prongs in place, for shipment or resale, and then are installed once the article is to be hung. The invention also provides alternative hanging capacities in the event that a conventional picture hanging technique may be preferred by the article hanger, e.g., wire and nail.

SUMMARY OF THE INVENTION

It is a first object of the present invention to provide an improved wall article hanging device.

Another object of the invention is to provide a method of hanging wall articles.

Still another object of the invention is a wall article hanging device offering the person hanging the article a number of options for hanging.

One other object of the invention is a prong-containing wall article hanging device, whereby the part without prongs can be attached to the wall article before shipping so as to reduce the risk of injury to a handler.

Yet another object of the invention is a multiple use method of hanging wall articles.

Other objects and advantages of the present invention will become apparent as a description thereof proceeds.

In satisfaction of the foregoing objects and advantages, the present invention provides a wall article hanging device that is an improvement over prior art types having prongs for attaching a wall article to a wall surface. The invention, in one embodiment, comprising a hanger body having a first end with at least one first opening and a second end with either at least one second opening or at least one article attachment prong. The hanger body has opposing slots, each extending along the hanger body. A prong element is provided that has at least one prong extending outwardly from an element body, opposing edges of the element body sized to engage the opposing slots of the hanger body so that the at least one prong extends outward of the hanger body when the prong element is engaged in the opposing slots.

In one embodiment, the opposing slots can be positioned between the first opening and either the at least one second opening or the at least one article attachment prong.

Alternatively, either the at least one second opening or the at least one article attachment prong is positioned between the opposing slots. The opposing slots can be angled towards the first opening to form a wedge shape or can be generally parallel to each other. The hanger body can be a plate with a pair of curled plate protrusions forming the opposing slots. Each free end of each plate protrusion can be angled with respect to a longitudinal axis of the hanger body so that the formed opposing slots are wedge shaped.

The second end can have a pair of second openings, and the prong element can have two or more prongs.

Depending on the environment of use, one or more than one device can be employed to hang a wall article.

The invention also entails a number of methods of hanging a wall article. In each method, a wall article if first provided and one or more hanger elements are secured to a back surface of the wall article. The securing step is performed by either inserting at least one article attachment prong into the back surface or inserting a fastener, e.g., a nail, screw or the like, through the at least one second opening and into the back surface.

The wall article is then attached to the wall surface by one of: (1) providing a prong element having at least one prong extending therefrom, and inserting edges of the prong element into the opposing slots with the at least one prong angling away from the wall article; and forcing the at least one prong into the wall surface by applying force to the wall article; (2) configuring or bending a portion of the hanger body surrounding the first opening away from the back surface of the wall article, and inserting a free end of an elongate member extending from the wall surface into the first opening to hang the wall article; or (3) providing at least a pair of hanger elements secured to the wall article in a spaced apart relationship, configuring or bending a portion of each of the hanger bodies surrounding each first opening away from the back surface of the wall article, linking a wire between each first opening and using the wire to support the wall article by engagement with at least one elongate member extending from the wall surface.

The hanger body can be first attached to the back surface using the at least one article attachment prong or the second opening, and the prong element can then be attached using the slots. Alternatively, the prong element can be attached first to the hanger element, and the assembled device can be attached to the wall article.

The invention encompasses any means for attaching the prong element to the hanger body for supporting the wall article on a wall using the prong(s) of the prong element, and means permitting separating the hanger body from prong element so that the prong does not extend from the hanger body to create a risk of injury during handling. The means for attaching entail at least the slots on the hanger element and the correspondingly sized prong element to permit the attachment and separation. Other structures achieving these functions are also within the scope of the invention.

BRIEF DESCRIPTION OF THE DRAWINGS

Reference is now made to the drawings of the invention wherein.

DESCRIPTION OF THE PREFERRED EMBODIMENTS

The present invention offers significant advantages in the field of hanging wall articles. The invention overcomes the problems of possible injury due to contact with the prongs of hanging devices. In addition, the inventive wall article hanging device gives the user the option to employ more than one technique to hang a wall article. Thus, a user is not limited to a single technique or system for article hanging, and the user can adapt to the particularities of a hanging location. For example, a nail, moly bolt, or other member may already be in place, and the existing member could be used in conjunction with the inventive hanging device. Alternatively, the wall article could be hung by merely assembling the prong element and hanger body together, and then use the prong element for attachment of the article to the wall.

The protection against injury is significant in terms of being able to attach one part of the inventive wall article hanging device to an article at a remote location, e.g., a manufacturing facility, a wholesaler, even a retailer. At the same time, the other part of the device, the prong element, can be stored separated from the device body in such a position that the prongs do not extend in a manner that could cause injury.

Figure 1A:
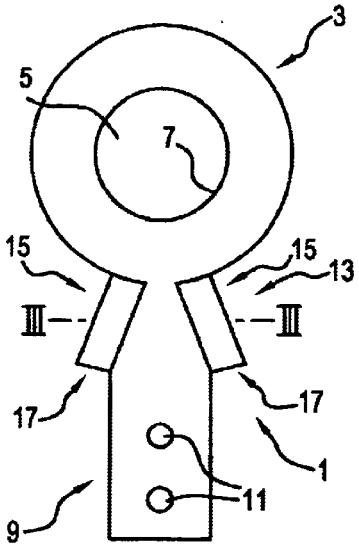
FIG. 1*a* is a front view of the hanger body of a first embodiment of the invention.
Figure 1B:
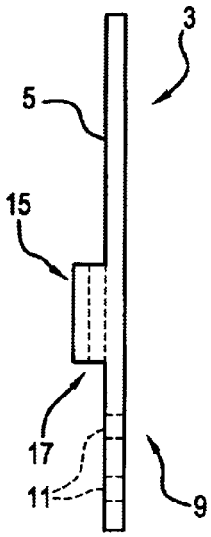
FIG. 1*b* is a side view of the hanger body of the first embodiment of the invention.

Referring now to FIGS. 1*a*–3, a first embodiment of a hanger device 10 of the invention is illustrated with FIG. 1 showing the device hanger element or body 1. The body 1 is elongate in shape, but could have other configurations as well. One end 3 has a generally annular configuration with an opening 5 therein. The opening is circular in shape but other shapes could also be used, e.g., oval, square, etc. Further, the end 3 could have a non-annular shape to form the opening, e.g., be T- or L-shaped, with the extending arms of the T or the arm of the L being serrated to catch a nail in the wall. In this variation, the opening in the end portion is considered to be the open edge of the underside of the arms. When employing the opening 5, the edge 7 can be rounded to facilitate use of the opening 5 with a wire or the like as described below. The body 1 is preferably made from plate stock.

The other end 9 of the body 1 has a pair of openings 11, (one or more than two openings could also be used). The openings 11 allow attachment of the body to a wall article for hanging, such as by fasteners, wires, etc.

The hanger body 1 has another segment 13 positioned between the openings 11 in the end portion 9 and the opening 5 in the end portion 3. The segment 13 has a pair of opposing slots 15. The slots has ends 17 accommodating both entry and exit.

In this embodiment, the slots 15 can be formed by rolling or curling opposing and protruding ears of the segment 13, such that the slots are integral with the segment 13. Of course, other ways may be employed to make the slots, e.g., merely spot weld u-shaped channels to the edges of the segment 13.

Figure 2A:
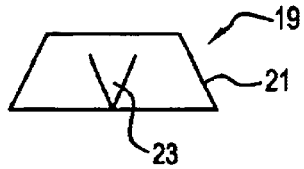
FIG. 2*a* is a front view of the prong element of the first embodiment.
Figure 2B:
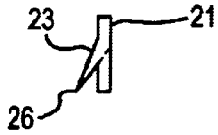
FIG. 2*b* is a side view of the prong element of the first embodiment.

Referring now to FIGS. 2*a* and 2*b*, a prong element 19 is shown with an element body 21 having a wedge or trapezoidal shape, and a prong 23 extending from the body 21. The prong 23 can be merely stamped from the body 21 such that a prong-shaped opening (not shown) remains in the body 21 after stamping. The prong element 19 is designed so that it can be separate from the body 1, or attached thereto. When separated, the prong 23 can be positioned so that the prong end 26 is minimally exposed. When the element 19 is linked to the body 1, the device is ready for hanging a wall article.

Figure 3:
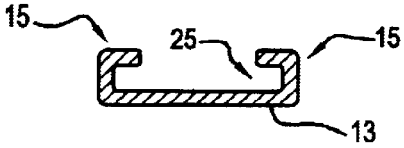
FIG. 3 is a cross section view along the line III—III of FIG. 1*a;*

The body 21 is sized in width to slide within the slot openings 25, see FIG. 3, and is further sized in shape to wedge between the slots 15. This wedging action keeps the body 21 in place while the wall article is being hung. The wedging action can be attained by sizing the slots 15 to frictionally retain the body 21 after insertion by engagement between the top and bottom of the body 21 and the opposing faces of the slots, but at the same time, allowing the body 21 to be removed if desired. Alternatively, the slots 15 could be crimped at specified intervals along their length to retain the body 21. The angulation of the body 21 and/or slots 15 can also be adjusted so that the side faces of the body 21 wedge against the opposing faces of the slots 15.

Figure 4:
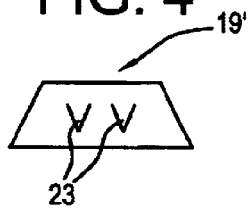
FIG. 4 shows an alternative prong element of the invention.

FIG. 4 shows an alternative removable element 19' with a pair of prongs 23.

Figure 5:
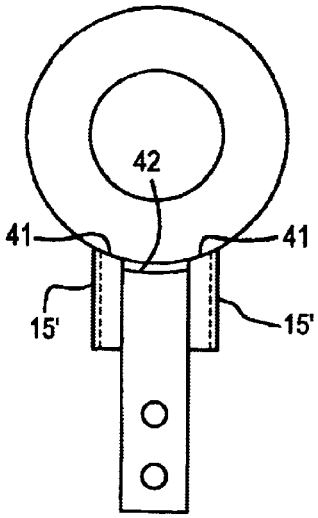
FIG. 5 is a front view of the second embodiment of the hanger body of FIG. 1.

FIG. 5 shows an alternative slot arrangement wherein the slots 15' are parallel to each other rather than angled as shown in FIG. 1*a*. In this embodiment, the slot ends 41 can employ a stop to prevent the removable element from sliding out of the slots. The stop can be crimped ends, a wall, a narrowing of the slot width, or the like. This embodiment also employs a reduced thickness portion 42, which facilitates bending of the end portion 3 as described below for alternative hanging methods.

Figure 6:
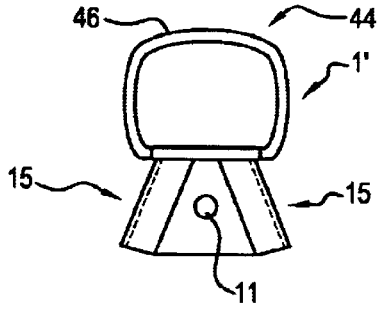
FIG. 6 is a front view of a third embodiment of the hanger body.

Another alternative of the device 10 is shown in FIG. 6. In this embodiment, the openings 11 can be positioned in the segment 13 of the body 1", and the end portion 9 can be eliminated. However, unlike device 10, the prong element 19 must be removed in order to remove the body 1", that is, the element 19 covers the openings 11 when in the slots 15. In the FIG. 1*a* embodiment, the prong element 19 can remain engaged in the slots 15 while the body 1 is removed from a wall article.

Showing yet another variation, the FIG. 6 embodiment also employs a "D" ring 44 in the end portion. The "D" ring has a loop portion 46, which rotates in the cylindrical segment 48, thus allowing the loop portion 46 to move with respect to an adjacent back of a wall article for installation, similar to that shown in FIG. 9.

Figure 7:
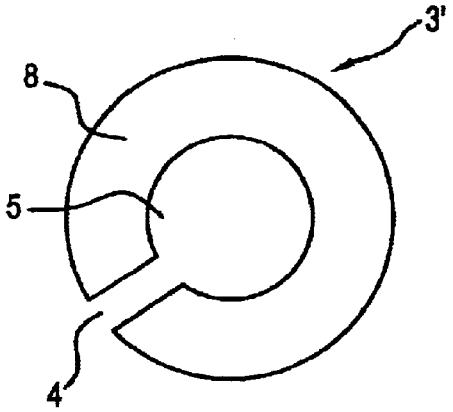
FIG. 7 is a partial front view of a fourth embodiment of the hanger body.

Yet another alternative is shown in FIG. 7 wherein the end 3' has a slot 4 to allow access to the opening 5. The slot 4 permits a wire loop or the like to be inserted around the annular portion 8 of the end portion 3' for attachment purposes as described below.

Figure 8:
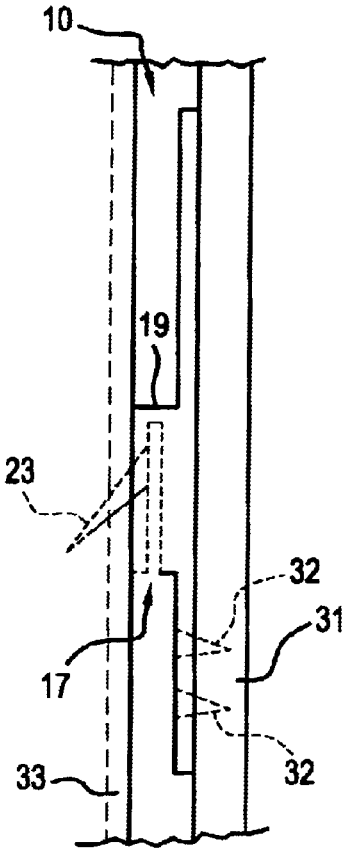
FIG. 8 is a side view of the embodiment of FIGS. 1*a*–2*b* in an exemplary use.

The inventive wall article hanging device can be used in a number of ways. Referring to FIG. 8, a first way parallels that taught in the Barnes patents noted above. That is, the body 1 is first attached to a wall article 31 using screws 32 extending through the holes 11. Then, the removable element 19 is inserted into the entry end 17 of the slots 15 so that the prong 23 faces away from both the body 1 and the wall article 31. The prong 23 is shown inserted at an angle into the wall 33, and the wall article 31 hangs flushly and generally parallel to the wall 33.

The separability of the element 19 is advantageous in that the prong 23 can be inserted into the slots 15 just before the wall article 31 is to be hung. With this flexibility, the body 1 can be attached to the wall article 31 well before it is to be hung, e.g., when manufactured or shipped. In this mode, the prong element 19 can be stored separately from the wall article and body 1 or it can attached to the article itself in such a manner that the prong(s) do not extend in a fashion that could cause injury, e.g., taped with the prong end facing a back of the wall article. Attaching the prong element to the article itself is more convenient for the article hanger in that the prong element 19 is readily available for insertion into the slots 15.

Figure 9:
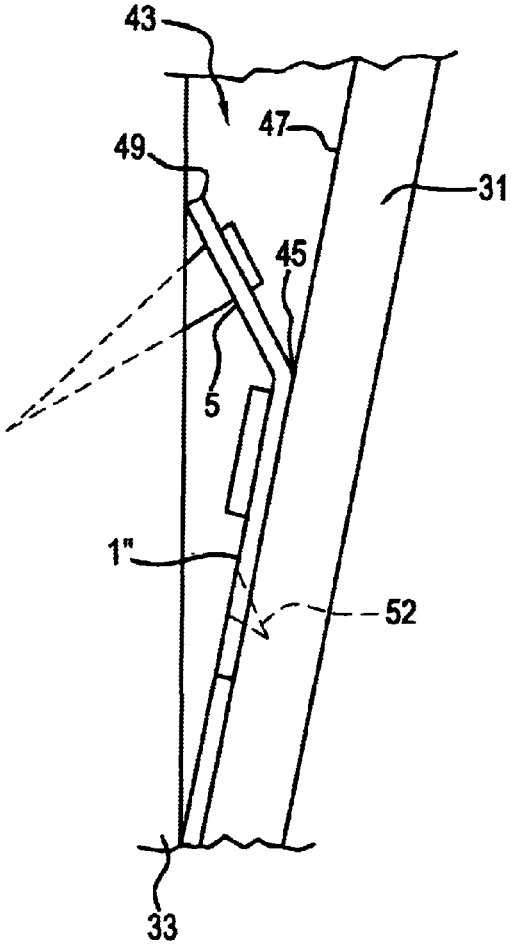
FIG. 9 is a side view of a second use of an alternative embodiment to that shown in FIGS. 1*a*–2*b*.

In another mode, referring now to FIG. 9, the opening 5 can be employed for hanging rather than the removable element 19. In this mode, the end 3 is shown bent away from the wall article using the reduced thickness portion 45 similar to that shown in the FIG. 5 embodiment. This bending can be done either before or after the body 1" is attached to the wall article. Once bent, a space 43 is formed between the end 3 and the back 47 of the wall article 31. This space 43 allows the end of a nail 49, a moly bolt, or other elongate element to extend through the opening 5 so that the end 3 is supported by the nail 49. The end then supports the wall article via the attachment of the body 1" to the wall article 31.

FIG. 9 also illustrates the body 1" with prong 52 in place of the openings 11 and fasteners 32 as shown in FIG. 8. The prongs 52 are inserted into the back of the article 31 first, and the same sequence is followed when using the opening 5 for hanging. Of course, the prong 52 can be used in replacement of the fasteners of FIG. 8 if desired. Although one prong is shown, two or more could be employed. Use of the prong as an attachment to the wall article is shown in U.S. Pat. No. 5,328,139.

Although the body 1 can have a necked or reduced thickness as shown in FIG. 5, to facilitate bending of the end 3 with respect to segment 13, the material and/or overall thickness of the body 1 can be tailored to allow the end 3 to be bent a sufficient degree to form the space 43 for hanging in a more conventional fashion. For example, the material strength could be adjusted to allow for bending without reducing the thickness of the body 1. The body 1 could be made with a thickness that allows bending.

Figure 10:
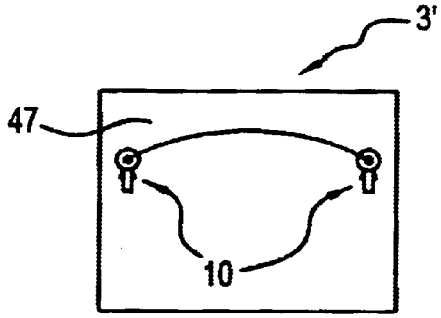
FIG. 10 is a schematic of a third use of the inventive wall article hanging device.

FIG. 10 shows a schematic of another way to hang a wall article. In this mode, a pair of devices 10 are attached in a spaced apart relationship to the back 47 of the wall article 31. The openings 5 provide securement points to string a wire or cable between the devices 10 so that the wire can be used to hang the article 31. In this embodiment, the end 3 may be bent to allow the wire to be inserted into the opening 5. However, the nature of the article back may allow enough clearance so that the wire can be inserted without bending.

In addition, the use of a pair of devices as shown in FIG. 10 can be employed with the techniques shown in FIGS. 8 and 9. When the prong element 19 utilizes only a single prong, it is preferred to use at least a pair of devices for hanging. The use of at least two prongs helps maintain the article in a level position. If a pair of prongs are employed on the element 19, a single device may be sufficient for article hanging.

While the mode of FIG. 9 shows that the body 1 is bent to form the space, the body 1 can be configured so that the end portion 3 is slightly angled with respect to at least the segment 13 so that the space 43 is formed once the body is attached to the back of the wall article. Imposing a slight angulation in the end portion 3 removes the need for a user to bend the body 1.

The material of the device can be any material having sufficient strength to support a wall article, but a preferred material is tempered carbon steel.

While the slots are shown as being angled or wedge shaped, the slots could be parallel as shown in FIG. 5, and one of a wall at the slot end, one or more crimps, slot and/or element 19 sizing, or other stopping configurations can be employed to prevent the removable element from merely sliding through the slot.

Besides entailing a device for hanging articles, the invention also includes methods for hanging wall articles that allow the wall article to be hung using different techniques depending on the preference of the individual and the circumstances surrounding the hanging.

Referring back to the FIGS. 1*a*–3 embodiment, each mode of the invention entails attaching the body 1 to a wall article. As shown in FIG. 8, a pair of screws would be used for fastening, or one or more prongs could be used as well, see FIG. 9.

In a first mode, once the body 1 is attached to a wall article, the prong element 19 can be inserted into the slots 15 with the prong 23 facing away from the article. Of course, the prong element 19 could be attached to the body 1 prior to attachment of the body 1 to the wall article, if so desired (excepting the FIG. 6 embodiment). The article can be leveled, and the prong 23 is then inserted into the wall by applying a force on the frame of the wall article. The leveling can also be done using the technique described in U.S. Pat. No. 5,758,858.

In a second mode and after the body 1 is attached, the end portion 9 can be bent if the body is a plate, or if using a "D" ring, the ring is rotated away from the back of the wall article. In either case, once a space is created between the opening in the end portion and the wall article back, a nail or other member (previously inserted into the wall) is inserted into the opening in the end portion for wall article support. As noted above, the end portion 3 of the hanger body can already be configured with a slight angle to form the space for hanging using a nail, wire, etc.

In a third mode, a pair of devices can be attached to the wall article in a spaced apart relationship, and a wire can be strung between the openings in the end portion 3. The wall article can then be hung using the wire and a nail or other member protruding from the wall. In this mode, a wire end can be wrapped around the annular part of the end portion, or a wire loop could be slipped around the annular part 8 shown in FIG. 7.

While slots are depicted for linking the prong element to the hanger body, other configurations can be employed that will allow the prong element to be connected to the body in such a fashion to allow article support, and be permitted to be easily separated for shipment, storage, etc. As an example, the slots could be discontinuous so that a pair of limited length unshaped channels could be used on either side for prong element retention. These types of channels would still have a slot, just that the slot length would be less than the continuous types illustrated in FIG. 1*a*. Other configurations could also be employed as long as the prong element can be separated and/or attached when desired.

As such, an invention has been disclosed in terms of preferred embodiments thereof which fulfills each and every one of the objects of the present invention as set forth above and provides a new and improved wall article hanging device and methods of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. The wall article hanging device comprising:

a) a one-piece hanger body having a first end with at least one first opening and a second end with at least one article attachment prong integrally and inseparably part of the one-piece hanger body and extending in a first direction acutely angled from a plane of the one-piece hanger body, and b) a one-piece wall attachment element having at least one wall attachment prong integrally and inseparably part of the wall attachment element and acutely angled in a second direction with respect to the hanger body plane, the at least one wall attachment prong extending from a rear face thereof; and c) means for attaching the one-piece wall attachment element to the one-piece hanger body and for maintaining the one-piece wall attachment element stationary with respect to the one-piece hanger body for supporting the wall article on a wall using the wall attachment prong, and separating the one-piece hanger body from the one-piece wall attachment element so that the wall attachment prong does not extend from the one-piece hanger body;

d) wherein the first opening in the first end remains as a throughhole in the hanger body after the one-piece wall attachment element is attached to the one-piece hanger body and the wall article is supported on a wall using the wall attachment prong.

2. A method of hanging a wall article comprising:

a) providing a wall article;

b) securing at least one hanger element to a back surface of the wall article, the hanger element comprising a one-piece hanger body having a first end with at least one first opening and a second end with at least one second opening, the one-piece hanger body further including a pair of L-shaped flanges extending from edges of the one-piece hanger body, the flanges forming opposing slots in a slot plane parallel to a plane of the one-piece hanger body, wherein a fastener extends through the at least one second opening into the back surface;

c) attaching the wall article to a wall surface by configuring a portion of the one-piece hanger body surrounding the first opening away from the back surface of the wall article of the wall article, and inserting a free end of an elongate member extending from the wall surface into the first opening to hang the wall article.

3. A method of hanging a wall article comprising:

a) providing a wall article;

b) securing at least one hanger element to a back surface of the wall article, the hanger element comprising a one-piece hanger body having a first end with at least one first opening and a second end with at least one second opening, the one-piece hanger body further including a pair of L-shaped flanges extending from edges of the one-piece hanger body, the flanges forming opposing slots in a slot plane parallel to a plane of the one-piece hanger body, wherein a fastener extends through the at least one second opening into the back surface;

c) attaching the wall article to a wall surface by providing a pair of hanger elements secured to the wall article in a spaced apart relationship, configuring a portion of each of the one-piece hanger bodies surrounding each first opening away from the back surface of the wall article, linking a wire between each first opening and using the wire to support the wall article by engagement with at least one elongate member extending from the wall surface.

4. A method of hanging a wall article comprising:

a) providing a wall article;

b) securing at least one hanger element to a back surface of the wall article, the hanger element comprising a one-piece hanger body having a first end with at least one first opening and a second end with at least one article attachment prong, the one-piece hanger body further including a pair of L-shaped flanges extending from edges of the one-piece hanger body, the flanges forming opposing slots in a slot plane parallel to a plane of the one-piece hanger body, wherein the at least one article attachment prong is inserted into the back surface;

c) attaching the wall article to a wall surface by configuring a portion of the one-piece hanger body surrounding the first opening away from the back surface of the wall article of the wall article, and inserting a free end of an elongate member extending from the wall surface into the first opening to hang the wall article.

5. A method of hanging a wall article comprising:

a) providing a wall article;

b) securing at least one hanger element to a back surface of the wall article, the hanger element comprising a one-piece hanger body having a first end with at least one first opening and a second end with at least one second opening, the one-piece hanger body further including a pair of L-shaped flanges extending from edges of the one-piece hanger body, the flanges forming opposing slots in a slot plane parallel to a plane of the one-piece hanger body, wherein the at least one article attachment prong is inserted into the back surface;

c) attaching the wall article to a wall surface by providing a pair of hanger elements secured to the wall article in a spaced apart relationship, configuring a portion of each of the one-piece hanger bodies surrounding each first opening away from the back surface of the wall article, linking a wire between each first opening and using the wire to support the wall article by engagement with at least one elongate member extending from the wall surface.

6. The wall article hanging device comprising:

a) a one-piece hanger body having a first end with at least one first opening and a second end with at least one second opening, and b) a one-piece wall attachment element having at least one wall attachment prong integrally and inseparably part of the wall attachment element and acutely angled with respect to the one-piece hanger body plane, the wall attachment prong extending from a rear face thereof; and c) means for attaching the one-piece wall attachment element to the one-piece hanger body and for maintaining the one-piece wall attachment element stationary with respect to the one-piece hanger body for supporting the wall article on a wall using the wall attachment prong, and separating the one-piece hanger body from the one-piece wall attachment element so that the wall attachment prong does not extend from the one-piece hanger body;

d) wherein the first opening in the first end remains as a throughhole in the one-piece hanger body after the wall attachment element is attached to the one-piece hanger body and the wall article is supported on a wall using the wall attachment prong.

* * * * *